United States Patent [19]

Sofen

[11] 4,280,431

[45] Jul. 28, 1981

[54] DEVICE FOR SUPPORTING AND STORING THE MAINSAIL OF A SAILBOAT ON THE BOOM THEREOF

[76] Inventor: Morris B. Sofen, 2602 Carlyle, Kalamazoo, Mich. 49008

[21] Appl. No.: 22,699

[22] Filed: Mar. 22, 1979

[51] Int. Cl.[3] ..... B63H 9/04

[52] U.S. Cl. ..... 114/105; 114/108; 114/97; 114/270

[58] Field of Search ..... 24/16 PB, 17 AP, 81 DS, 24/81 G, 81 KK, 255 BS, 256, 257; 114/39, 102, 103, 270, 104, 105, 106–108

[56] References Cited

U.S. PATENT DOCUMENTS

| | | | |
|---|---|---|---|
| 1,478,896 | 12/1923 | Ferency | 24/256 |
| 2,650,448 | 9/1953 | Lichtig | 24/256 |
| 2,935,773 | 5/1960 | Weckesser | 24/17 AP |

FOREIGN PATENT DOCUMENTS

| | | | |
|---|---|---|---|
| 1492042 | 4/1967 | France | 114/104 |

*Primary Examiner*—Trygve M. Blix
*Assistant Examiner*—D. W. Keen
*Attorney, Agent, or Firm*—Samuel Kurlandsky

[57] ABSTRACT

A device for supporting and storing the mainsail of a sailboat on the boom thereof comprising one or more support members composed of a resilient material having resilient clamp apparatus at a median portion thereof adapted to be mounted in clamping engagement with the boom, and flexible arms extending therefrom adapted to support the mainsail as it is lowered and being sufficiently flexible to be folded around the sail and having apparatus at its ends adapted to be affixed to each other, thereby securing the sail to the boom in folded condition.

6 Claims, 9 Drawing Figures

DEVICE FOR SUPPORTING AND STORING THE MAINSAIL OF A SAILBOAT ON THE BOOM THEREOF

BACKGROUND OF THE INVENTION (1) Field of the Invention

The present invention relates to the sailboat art and is more particularly concerned with a device for supporting a mainsail as it is unfurled and having arms to be wrapped around the folded sail and be secured to each other, thereby containing the folded sail in folded condition.

(2) Description of the Prior Art

When a sail of a sailboat is dropped for storage, it commonly spills over the boom and drops to the deck of the boat. It is then necessary to gather up the sail and to tie it in place on the boom by means such as a rope, called a sail stop. This can be a very clumsy process which is time consuming. Various means and devices have been tried in order to facilitate the storage of the sail. However, none has proved entirely satisfactory.

SUMMARY OF THE INVENTION

It is accordingly an object of the present invention to provide a means for catching a dropping sail and retain it on the boom before it drops to the boat deck.

It is a further object to provide a device of the type described which is easily mounted on the boom of a sailboat.

It is still an additional object to provide a device of the type described which can be easily fabricated and which is relatively inexpensive.

Other objects and advantages of the present invention will become apparent from the following description and from the drawing.

DESCRIPTION OF THE PREFERRED EMBODIMENTS

Figure 1:
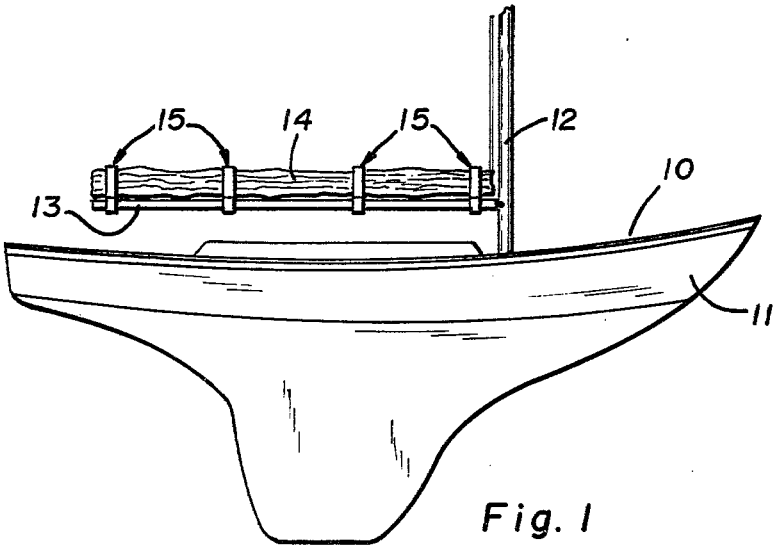
FIG. 1 is a side elevational view of a sailboat showing a mainsail stored on the boom thereof by means of the present invention.

Referring to FIG. 1, a sailboat is shown comprising a hull 11 and a mast 12. A boom 13 is slidably mounted at one end to the mast 12 and is secured by various lines to the mast and hull (not shown). A sail 14 is secured to the mast by means of clamping device 15 prepared according to the invention.

Figure 2:
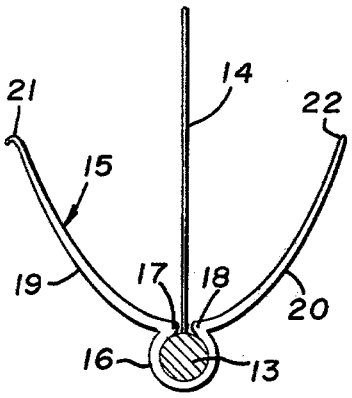
FIG. 2 is an end view partly in cross-section showing a strapping device according to the present invention mounted on a boom.

Referring to FIG. 2 the sailboat boom 13 is shown and has the sail 14 affixed thereto at one edge, the sail being in fully unfolded and erect position, as during sailing. Clamped about the boom 13 is a clamping device 15 according to the invention. The clamping device 15 is integrally formed from a suitable material such as synthetic plastics and comprises a boom engaging loop 16 terminating in a pair of clamping jaws 17 and 18. A pair of arms 19 and 20 which are integral extensions of the clamping jaws 17 and 18, respectively. These devices are easily snapped off at will. At the ends of the arms 19 and 20 are complementary engaging securing means 21 and 22 for securing the ends of the two arms together.

Figure 3:
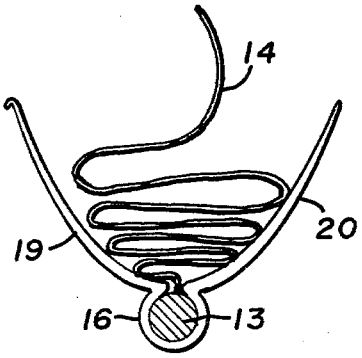
FIG. 3 is an end view partly in cross-section of a device according to the invention mounted on a boom and with the sail partly folded.
Figure 4:
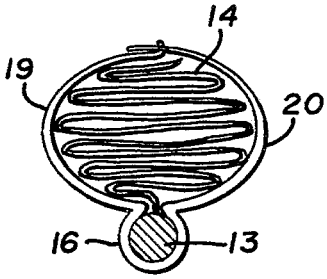
FIG. 4 is an end view partly in cross-section of the present invention mounted on a mast with the folded sail completely enclosed and secured within the clamping device.

As shown in FIG. 3, as the sail, in this instance the mainsail, is lowered and folded against the boom 13, the arms 19 and 20 gather the folds together and support them above the boom. The arms 19 and 20 are formed of a material and in such dimensions that they are sufficiently strong and rigid to support the folds of the sail when the sail is lowered and prevent the sail from falling to the deck of the boat. However, the material must nevertheless be somewhat flexible so that after the entire sail has been received, the arms may be bent about and completely the enclose the entire sail and then to have the ends of the arms secured to each other form securing the entire sail to the mast. This is shown in FIG. 4.

Figure 5:
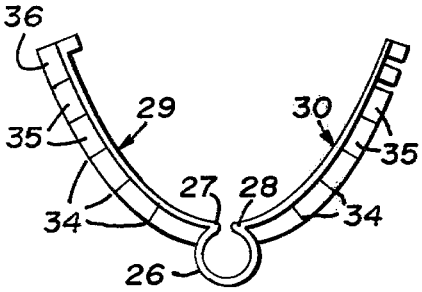
FIG. 5 is an elevational view of a clamping device according to the invention in another embodiment.
Figure 6:
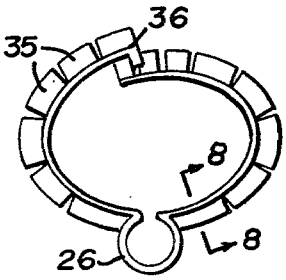
FIG. 6 is an elevational view of a clamping device shown in FIG. 5 but in locked position.
Figure 8:
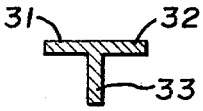
FIG. 8 is a cross-sectional view taken at the line 8—8 of either FIGS. 6 or 7, looking in the direction of the arrows.

Referring to FIGS. 5, 6 and 8, a somewhat modified embodiment is shown comprising a boom engaging loop 26, clamping jaws 27 and 28, and arms 29 and 30 extending therefrom respectively. As shown more particularly in FIG. 8 the arms of T-shaped crossed-section comprising lateral arms 31 and 32 and a vertical flange 33. As shown in FIGS. 5 and 6, the vertical flange 33 is provided with a plurality of slits 34 extending to but stopping short of the lateral arms 31 and 32, thereby dividing the vertical flange 33 into a plurality of segments 35. The slits are provided to make the arms more flexible when being raised to fold about the sail, but to make the arms more rigid when they are unfolded in a sail receiving position, since then the segments 35 engage at their edges and prevent the arms from being bent downward by the weight of the sail. As shown in FIG. 5, a hook 36 may be provided on the end of one arm to engage a slit 34 at the end of the other arm for securing the ends of the arms together.

Figure 7:
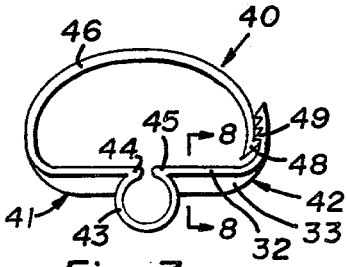
FIG. 7 is an elevational view of another embodiment of the invention.

Referring to FIG. 7, a sail supporting and storing device 40 is shown comprising a pair of supporting arms 41 and 42 are shown connected together by a resilient ring 43 terminating in clamping jaws 44 and 45. The ring 43 and the jaws 44 and 45 cooperate to form a snap-on clamp for securing the device to the boom of a sailboat. The arms 41 and 42 are connected to the ring 43 and the jaws 44 and 45 as shown. The arms 41 and 42 have cross-sections such as shown in FIG. 8 comprising lateral arms 31 and 32 and a vertical flange 33. The vertical flange 33 continues only along a portion of the arms 41 and 42 and provides vertical support for the sail. The lateral arm 41 continues as a sail engaging strap 46 which does not have a vertical flange, thereby rendering the strap 46 more flexible to be wrapped around the folded sail. The end of the strap 46 is provided with a hook 48 which is adapted to engage a complementary hook 49 provided on the arm 42.

Figure 9:
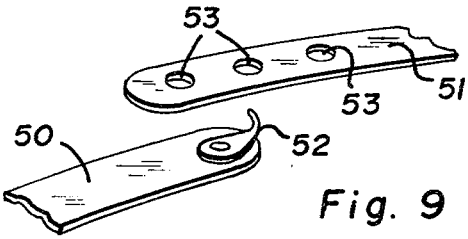
FIG. 9 is a perspective showing the ends of a pair of arms according to the invention with an alternative means of securing the ends together.

Referring to FIG. 9, the ends of two arms or straps 50 and 51 are shown, illustrating another embodiment of the invention for fastening the two sail-engaging arms together. This embodiment may be utilized for securing the ends of the arms together in the embodiments of FIGS. 2–4, or, with modifications the embodiment of FIG. 7. The arm 50 has a hook 52 affixed to the end thereof, while the arm 51 is provided with a plurality of holes 53 adapted to be engaged by the hook 52 in one of several adjustable positions.

In using the sail supporting and securing devices of the present invention, one or more devices are affixed to the sailboat boom by snapping the clamping jaws over the boom. The jaws are so shaped and formed of such a material that they are spread apart upon being pressed against the boom. When the jaws pass over the central portion of the boom they snap shut because of the resilience of the clamp material and remain affixed to the boom until subsequently removed by pulling them away from the boom. Because the lower portions of the arms are preferably shaped to prevent undue flexing, they offer excellent support for receiving a sail. When the fully extended sail 14, as shown in FIG. 2 is lowered, it forms in folds in the space between the arms 19 and 20 of the supporting device, as shown in FIG. 3. After the sail has been fully lowered, the ends of the arms 19 and 20 are drawn over the folded sail and secured together by the complementary hooking means 21 and 22, 36 and 34, 48 and 49, or 52 and 53. The sail 14 is now securing retained against the boom 13 by means of the supporting and storing devices 15, as shown in FIG. 1. Alternatively, the other embodiments shown may be similarly utilized with excellent results.

The sail supporting and securing device of the present invention may be formed of any of a large number of suitable materials. The preferred materials are synthetic plastics. The materials which are preferred are those which are somewhat resilient so that the arms may be bent around the folded sail, but which provide sufficient clamping force for maintaining the device clamped to the boom. Among suitable materials are synthetic polymers such as polyethylene, polypropylene, polycarbonates, polyurethanes, polyvinyl materials, and many other similar or related polymeric materials. It is necessary that the material have adequate flexing properties so that the jaws of the clamp spread apart when the clamp is applied to the boom of the sailboat. The material must also be sufficiently resilient so the jaws clamp about the boom and provide sufficient engagement with the boom to support the weight of the sail. The arms of the supporting and securing device may be made somewhat thinner so that they are more resilient to facilitate bending and wrapping about the folded sail. In order to provide a structure which has good supportive strength but yet is flexible, a structure such as shown in FIGS. 5 and 6 may be utilized. Alternatively a stiffening flange 33 such as shown in FIG. 7 may be utilized, with the arm or arms themselves being formed to have a flat in the form of a strap with a wide but thin cross-section, such as shown in FIG. 8. Various fastening means may be utilized to fasten the two ends of the arms together for securing the folded sail, such as those shown in FIGS. 2–4, which comprise an integral hooks of one strap engaging holes provided in the end of the other arm. Alternatively, as shown in FIGS. 5 and 6, a hook may be provided at one end which engages a slip 34 at the end of the other arm. Alternatively, integral complementary hooks 48 and 49 such as shown in FIG. 7 or the hooks and holes shown in FIG. 9 may be used to secure the two ends of the arms together for storing the sail.

The sail supporting and securing device of the present invention has a number of advantages. First, they may be readily and relatively inexpensively formed from synthetic plastic materials by molding, extruding, or other commonly used methods of fabrication. The devices are very easily secured to the boom of a sailboat by pressing the clamping portion of the device over a boom of a sailboat, where it remains strongly secured. When the sail is lowered, it folds into the space between the arms of the devices and is securely supported thereby until the entire sail has become folded. The arms are then readily wrapped around the folded sail and secured at their ends. The sail is thus securely stored against the boom. When it is desired to raise the sail again, the ends of the storing and engaging devices are quickly disengaged and quickly removed from the boom by snap action.

It is to be understood that the invention is not to be limited to the exact details of composition, materials or operation as shown or described, as obvious modifications and equivalents will be apparent to one skilled in the art.

Invention is claimed as follows:

1. A device for supporting and storing the mainsail in folded condition on the boom of a sailboat, said device comprising a body portion having integral clamping means for affixing said device to said boom, said clamping means comprising an integral pair of converging jaws spaced-apart a distance smaller than the thickness of said boom and arranged to be spread apart when pressed onto said boom and to retract sufficiently around said boom when in position to securely affix said device to said boom, a pair of arms integral with and extending from said body portion, said arms being flexible upwardly and adapted to be wrapped around said folded sail, and fastening means at the ends of said arms for fastening the ends of said arms together and around said folded sail and securing said sail to said boom.

2. A device according to claim 1, formed of a plastic material.

3. A device according to claim 1, wherein the ends of said arms are provided with complementary integral hooks, to provide adjustable fastening.

4. A device according to claim 1, wherein said body portion has a T-shaped cross-section comprising a pair of lateral arms and a vertical flange.

5. A device according to claim 4, wherein said vertical flange is cut to provide a plurality of adjacent segments, thereby rendering said arms flexible in an upward direction for being bent around said folded sail, but adapted to be rigid downwardly when extended in order to provide support for said sail when said sail is being folded.

6. A device according to claim 5, wherein one end is provided with an integral hook for engaging the segments of the other arm for fastening in one of a number of adjustable positions.

* * * * *